US005131117A

United States Patent [19]

Gallo et al.

[11] Patent Number: 5,131,117

[45] Date of Patent: Jul. 21, 1992

[54] STRAIGHT COMBING MACHINE FOR WOOL AND A COMBING METHOD

[75] Inventors: Carlo Gallo, Mongrando; Dino Mirra, Valle S. Nicolao, both of Italy

[73] Assignee: Pettinatura Europa S.r.l., Vercelli, Italy

[21] Appl. No.: 598,609

[22] PCT Filed: Feb. 20, 1990

[86] PCT No.: PCT/EP90/00275

§ 371 Date: Oct. 22, 1990

§ 102(e) Date: Oct. 22, 1990

[87] PCT Pub. No.: WO90/10102

PCT Pub. Date: Sep. 7, 1990

[30] Foreign Application Priority Data

Feb. 22, 1989 [IT] Italy ..... 67117 A/89
Feb. 22, 1989 [IT] Italy ..... 67118 A/89

[51] Int. Cl.[5] ..... D01G 19/16

[52] U.S. Cl. ..... 19/234; 19/215; 19/225; 19/235

[58] Field of Search ..... 19/215, 226, 234, 235, 19/225, 229

[56] References Cited

U.S. PATENT DOCUMENTS

| | | | |
|---|---|---|---|
| 2,977,642 | 4/1961 | Edfors | 19/234 |
| 5,029,366 | 7/1991 | Bischofberger et al. | 19/225 |
| 5,060,346 | 10/1991 | Bischofberger et al. | 19/225 |

FOREIGN PATENT DOCUMENTS

| | | | |
|---|---|---|---|
| 27258 | 5/1884 | Fed. Rep. of Germany . | |
| 11442 | 2/1894 | Fed. Rep. of Germany | 19/234 |
| 399885 | 5/1921 | Fed. Rep. of Germany . | |
| 1203890 | 1/1960 | France | 19/235 |
| 46-16288 | 5/1971 | Japan | 19/215 |
| 404485 | 6/1966 | Switzerland . | |
| 475379 | 7/1969 | Switzerland . | |
| 241 | of 1852 | United Kingdom | 19/215 |
| 53 | of 1856 | United Kingdom | 19/226 |

*Primary Examiner*—Werner H. Schroeder
*Assistant Examiner*—John J. Calvert
*Attorney, Agent, or Firm*—Sughrue, Mion, Zinn, Macpeak & Seas

[57] ABSTRACT

A straight wool-combing machine (10) has, instead of the conventional pair of detaching rollers, a pair of jaws (30, 32) for gripping the combed end of a tuft and for separating it, by a withdrawal movement, from the rest of the fibre sliver (M). The pair of jaws (30, 32) has a suction fan (31) for transporting the combed fibres pneumatically to a collecting store.

7 Claims, 7 Drawing Sheets

STRAIGHT COMBING MACHINE FOR WOOL AND A COMBING METHOD

BACKGROUND OF THE INVENTION

The present invention relates to a straight combing machine for combing a sliver of fibres, particularly woollen fibers, comprising a support structure, a circular comb rotatably mounted on the structure, means for supplying the fibres to the circular comb and means for removing the combed fibres from the circular comb.

In conventional combing machines in which the means for removing the combed fibres comprise, as is known, a pair of detaching rollers and a leather sleeve which is interposed between the detaching rollers to improve the grip and serves as a conveyor plane for the tufts, the slivers of fibres normally supplied include fibres having an average length of more than 45–50 mm. These fibres, which have been washed and subsequently carded, are subjected to conventional combed spinning after the combing process.

With so-called "short" wools, that is with fibres having an average length of less than 40–45 mm, a problem arises with conventional straight combing machines in that too many fibres are discarded (noil) which means that the combing of short wools is not economically worthwhile.

SUMMARY

The object of the present invention is to provide a combing machine and a combing method which overcome the aforesaid problem.

According to the invention, this object is achieved by virtue of the fact that the means for removing the fibres from the circular comb comprise pincers for gripping the fibres and detaching them from the circular comb.

The use of pincers for gripping the ends of the tufts enables closer approach to the fixed comb and thus enables shorter tufts to be combed.

Suction means are preferably associated with the pincers for transporting the combed fibres to fibre-collection means when the pincers open.

As well as ensuring that the end of the tuft is arranged correctly to be gripped by the pincers, the suction means thus also remove the fibre flocks pneumatically to a storage device.

In current combing machines, in order to improve the penetration of the fibre tufts between the teeth of the comb, so-called mechanical "embedding" devices are used for urging the fibres towards the teeth of the comb to increase the combing efficiency.

As well as being quite complex structurally, these mechanical devices limit the number of beats per minute effected by the combing machine, thus restricting any increase in the productivity of the machine. Conventional embedders also require accurate regulation in relation to the timing of the circular comb.

In order to overcome this further problem, the combing machine of the present invention, which is of the type in which the circular comb is in the form of a hollow cylinder, also has a substantially longitudinal elongate aperture in the side wall of the comb, the interior of the circular comb being in communication with a vacuum source so as to encourage the penetration of the fibres of the silver between the teeth of the comb by suction.

By virtue of this further characteristic, it is no longer necessary to use so-called mechanical "embedding" devices which, because of the complexity of their structure, drive and setting up, limit the productivity of the machine.

With the use of suction towards the interior of the circular comb to embed the fibres in the teeth of the comb, it is possible to increase the operating rate (cycles per minute) of the machine without mechanical problems.

BRIEF DESCRIPTION OF THE DRAWING

Further characteristics and advantages of the combing machine and of the method of the invention will become clear from the detailed description which follows with reference to the appended drawings, provided by way of non-limiting example, in which.

DETAILED DESCRIPTION OF THE INVENTION

Figure 1:
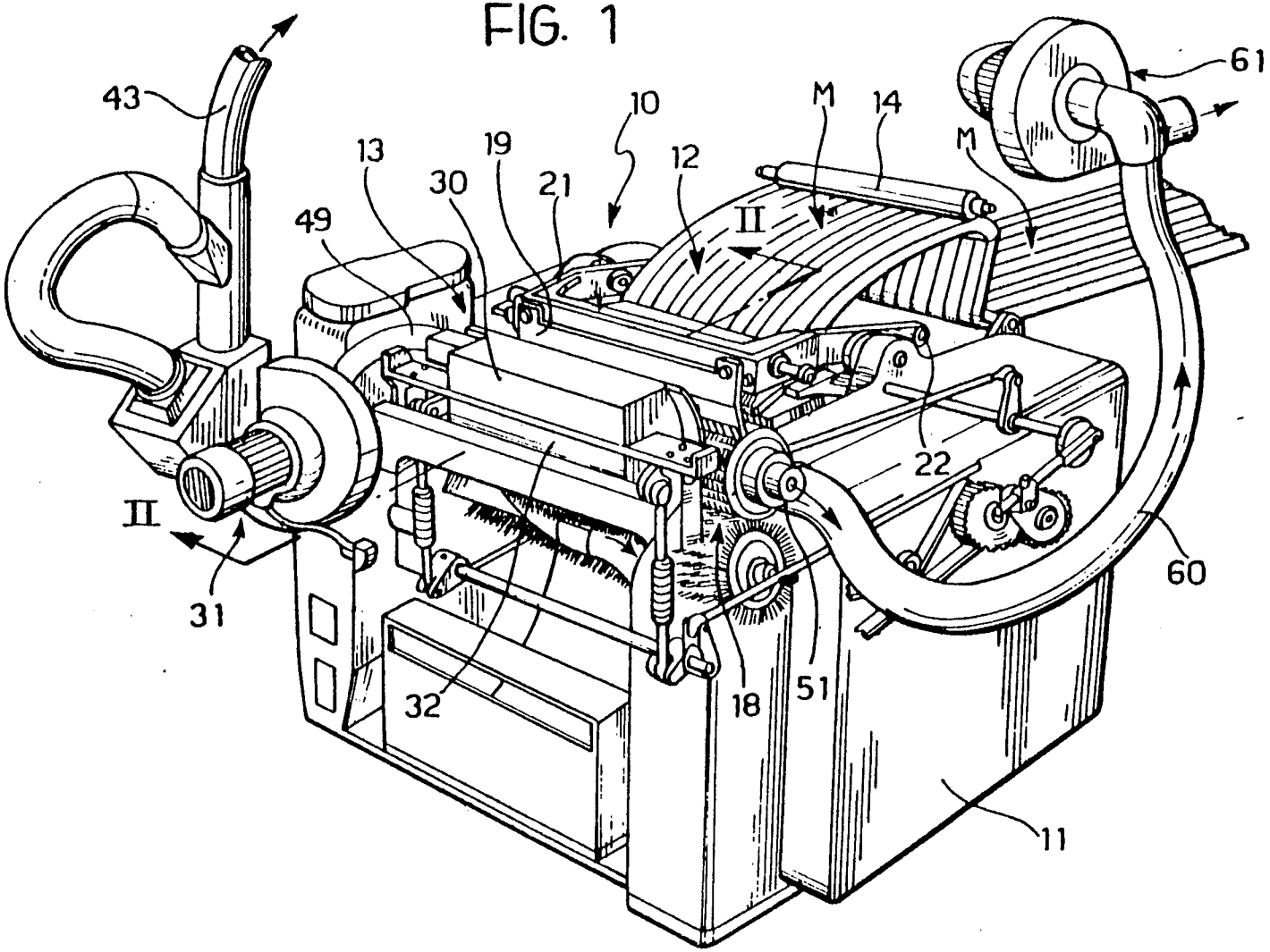
FIG. 1 is a perspective view of a combing machine according to the invention.

With reference to the drawings, a wool-combing machine is generally indicated 10 and includes a support structure 11, a feed unit 12 and a detaching unit 13. Slivers of wool-fibres, combined closely together so as to form a compact web M of even thickness, are fed to the machine 10 in known manner. The web is entrained by feed rollers 14 and is conveyed to the feed unit 12 which comprises an array of oscillating needles 15 which advance the web M intermittently.

A lower nipper 16 and an upper nipper 17 are pivoted to the structure 11 of the machine and arranged to hold a tuft C of fibres while it is being combed by a circular comb 18. The lower nipper 16 and the upper nipper 17 have respective ends 16*a* and 17*a* for gripping an end portion $M_1$ of the web M so as to define the tuft C which projects from the clamped nippers. A straight comb 19 is also arranged in the feed zone of the machine and is fixed at 2 to an oscillating structure 21 pivoted at 22 to the support structure of the machine. The straight comb 19 is used in known manner to comb the rear end of the tuft C. The straight comb 19 is cleaned by a brush 23 carried by the upper nipper 17.

The machine described hitherto does not differ substantially form conventional combing machines. The innovative characteristics of the machine according to the invention relate primarily to the zone in which the tufts of fibres are detached.

Figure 2:
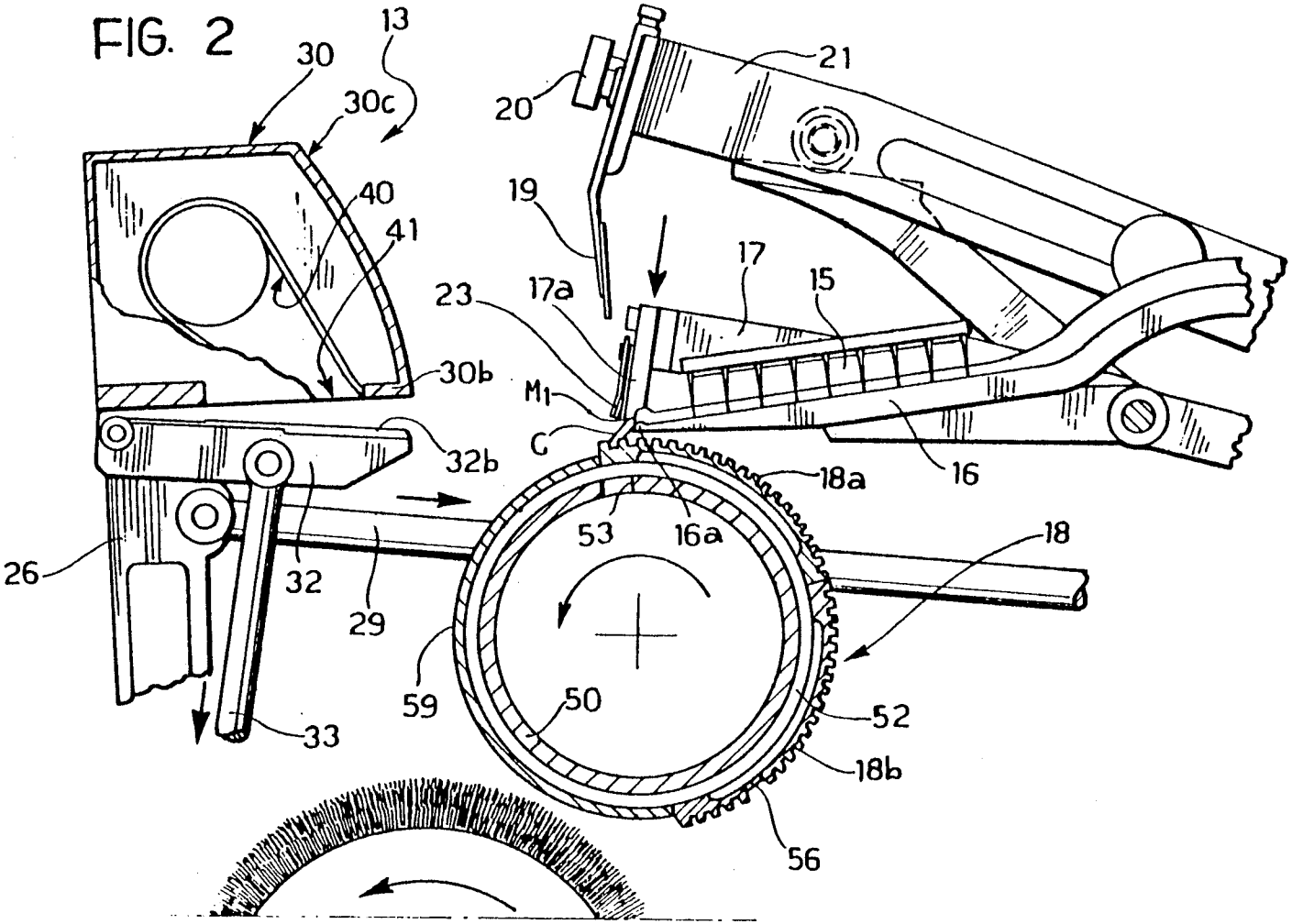
FIG. 2 is a section taken on the line II—II of FIG. 1.

With particular reference to FIGS. 1 and 2, an oscillating assembly 25 is pivoted to the support structure 11 of the machine about a horizontal axis X—X and comprises two parallel arms 26, each pivoted at a first end 26*a* to a shaft 27 and having its second end 26*b* fixed to a cross-member 28 which interconnects the arms 26 and is parallel to the articulation axis X—X. The oscillation of the assembly 25 about the axis X—X is driven in synchronism with the machine by means of a pair of connecting rods 29, as will become clear from the description of the operation of the machine.

A suction manifold 30 is connected to the cross-member 28 of the oscillating assembly 25 and is connected at 30*a*, by means of a connecting tube 49, to the inlet of a suction fan 31. The manifold 30 has a lower edge portion 30*b* defining a first jaw of a pincer device. The manifold 30 also has a wall 30*c* which faces the supply unit 12 and has a curved shape in order to prevent interference with the movement of other members of the machine.

A lower jaw 32 is pivoted to the manifold 30 about a horizontal axis Y—Y parallel to the articulation axis X—X of the oscillating assembly and has an active portion 32*b* facing the portion 30*b* of the manifold 30. The second jaw 32 is moved by means of a pair of connecting rods 33 each pivoted at a first end to the jaw 32 (about a horizontal axis parallel to the axis Y—Y) and at a second end to one of a pair of levers 34 keyed to the shaft 27 which is mounted for rotation relative to the support structure 11. The shaft 27 is reciprocated about its axis by a further lever 35 keyed to one end 27*a* of the shaft 27 with the aid of a connecting rod 37 which is driven in synchronism with the machine. Each connecting rod 33 is also provided with a compression spring 33*a* arranged during the design stage to achieve a predetermined clamping force between the jaws 30*b* and 32*b*.

The manifold 30 has an internal duct 40 which communicates with a straight slot 41 adjacent the first jaw 30*b*. The duct 40 communicates through the connector 30*a* with delivery tubing 43 connected to a store (not shown), the fan 31 being arranged in this tubing.

According to another characteristic of the invention the circular comb 18, which has two segments 18*a* and 18*b* respectively provided with needles, has an internal tubular support body 50 whose interior is connected through a connector 51 to tubing 60 leading to a vacuum source constituted, for example, by a blower fan 61.

A space 52 is defined between the tubular body 50 and the circular segments 18*a* and 18*b* and communicates with the connector 51 through a straight slot 53 formed in the wall of the tubular body 50. Similarly, a straight slot 56 is provided in a recessed portion 57 of the second segment 18*b* of the circular comb which is the segment which has the denser distribution of needles 55. This recessed portion 57 is located between rows of teeth 55 substantially adjacent a curved connecting element 59 of the circular comb 18.

When the machine 10 is operating, at the stage shown in FIG. 2 the tuft C is combed by the circular comb 18 which, by virtue of the low pressure created in correspondence with the straight slot 56 and of the connection of the tubular body 50 to the vacuum source 61, draws the tuft C towards its lateral surface where the teeth of the comb are closer together. This "centripetal" suction ensures that the fibres constituting the tuft are drawn down fully between the teeth 55 of the circular comb 18. The suction starts before the circular comb 18 has reached the position in which its slot 56 is located in correspondence with the tuft C and stops when the latter has been combed.

The "timing" of the suction through the slot 56 is regulated, for example, by means of a distributor disc with suitable apertures placed in correspondence with the connector 51.

Figure 3:
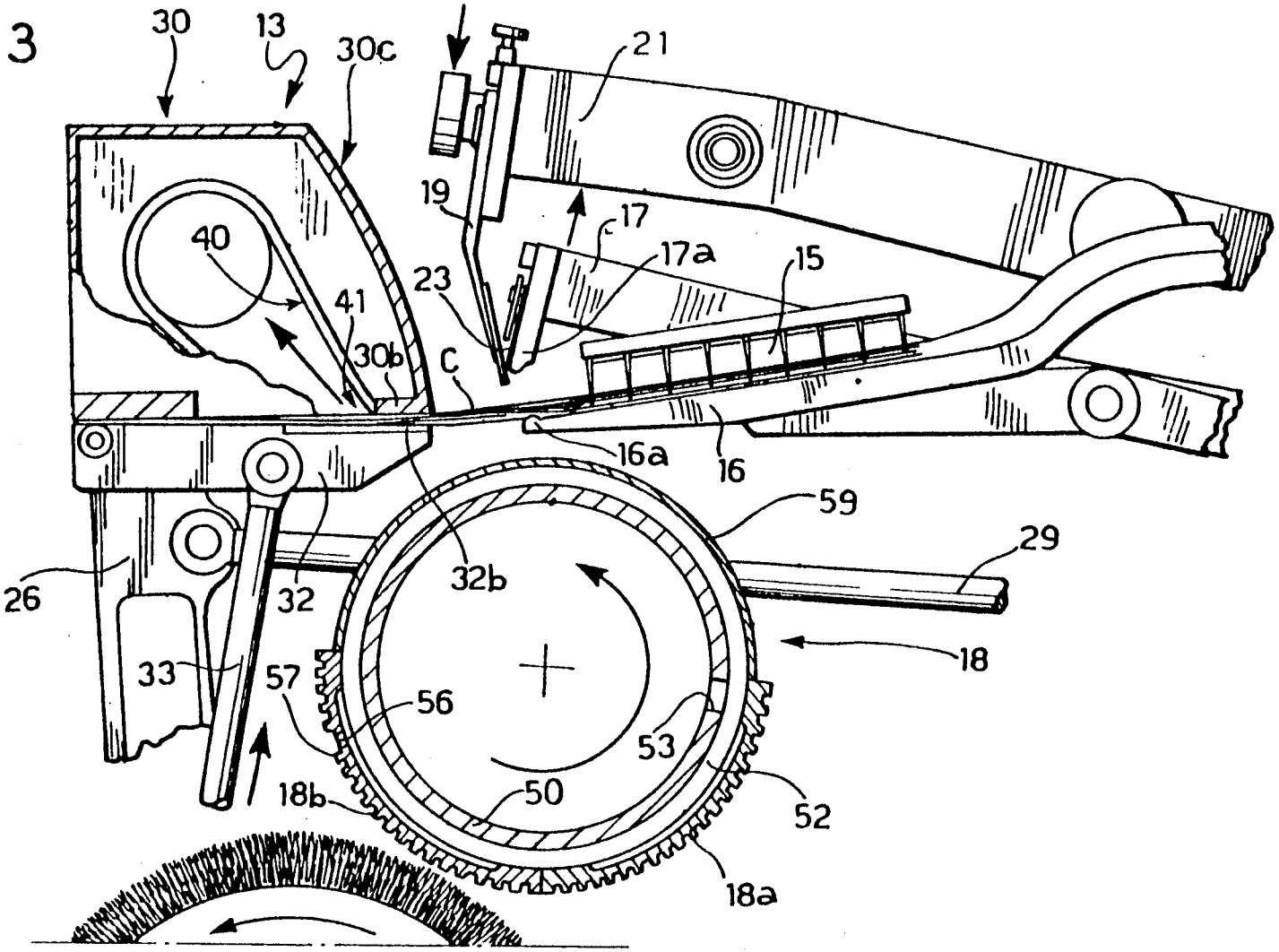
FIG. 3 is a view similar to FIG. 2 showing a different stage in the working cycle of the machine.
Figure 4:
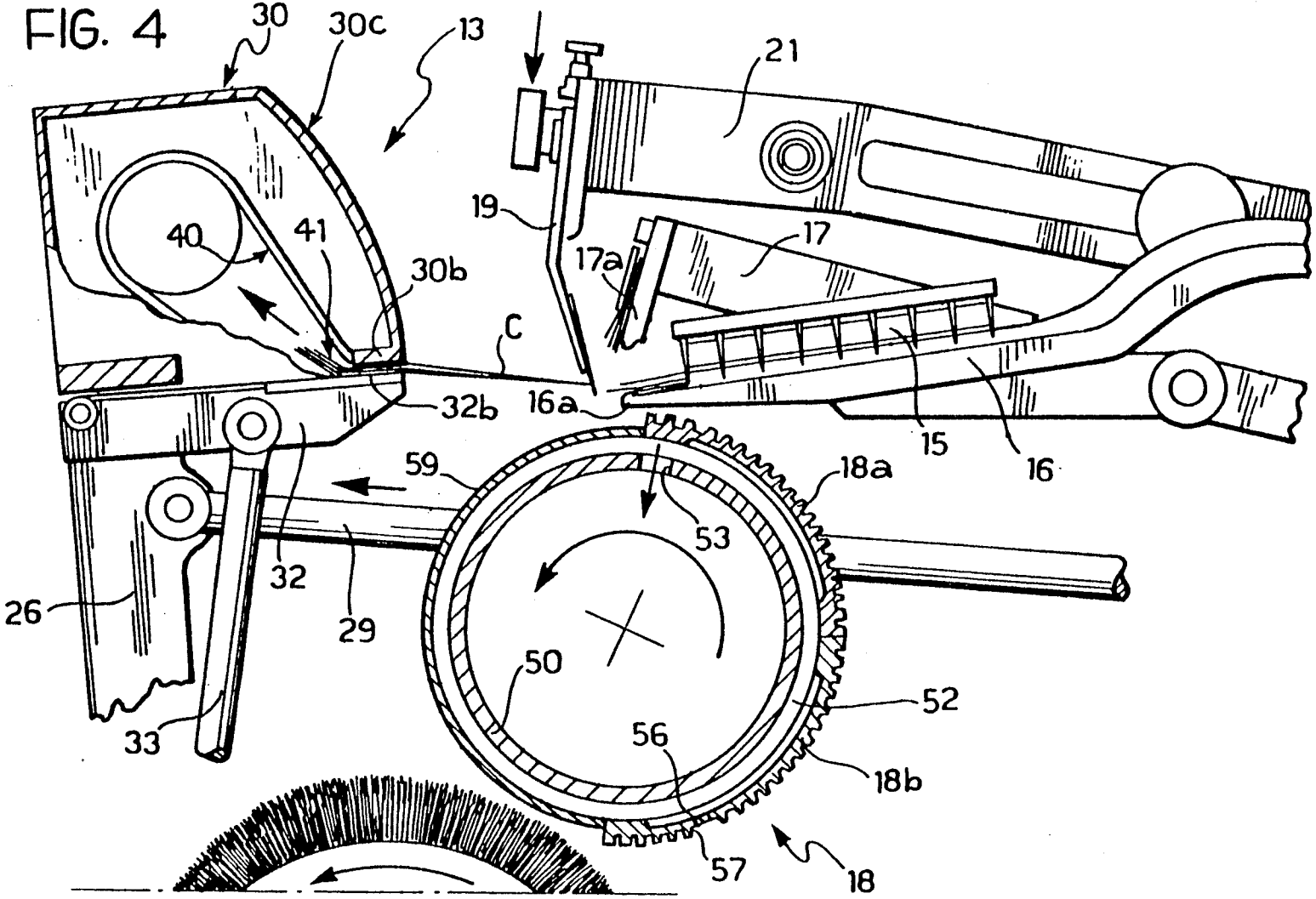
FIG. 4 is a view similar to FIGS. 2 and 3 and shows a further stage in the working cycle of the machine.
Figure 5:
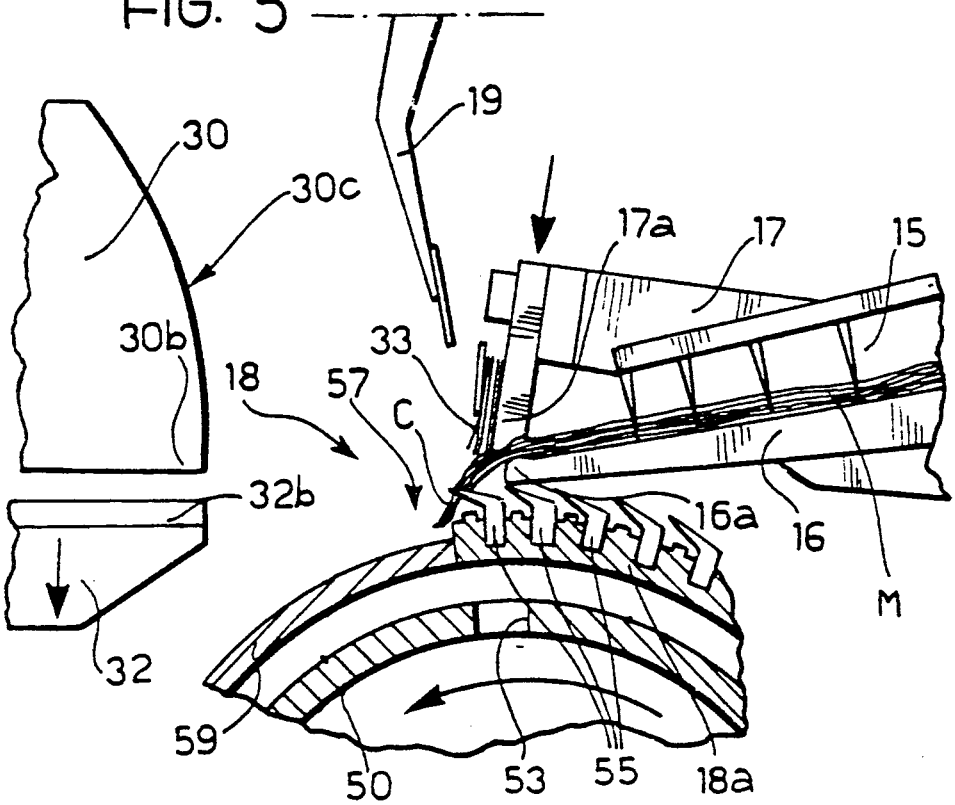
FIG. 5 is a view of a detail of FIG. 2 on an enlarged scale.
Figure 6:
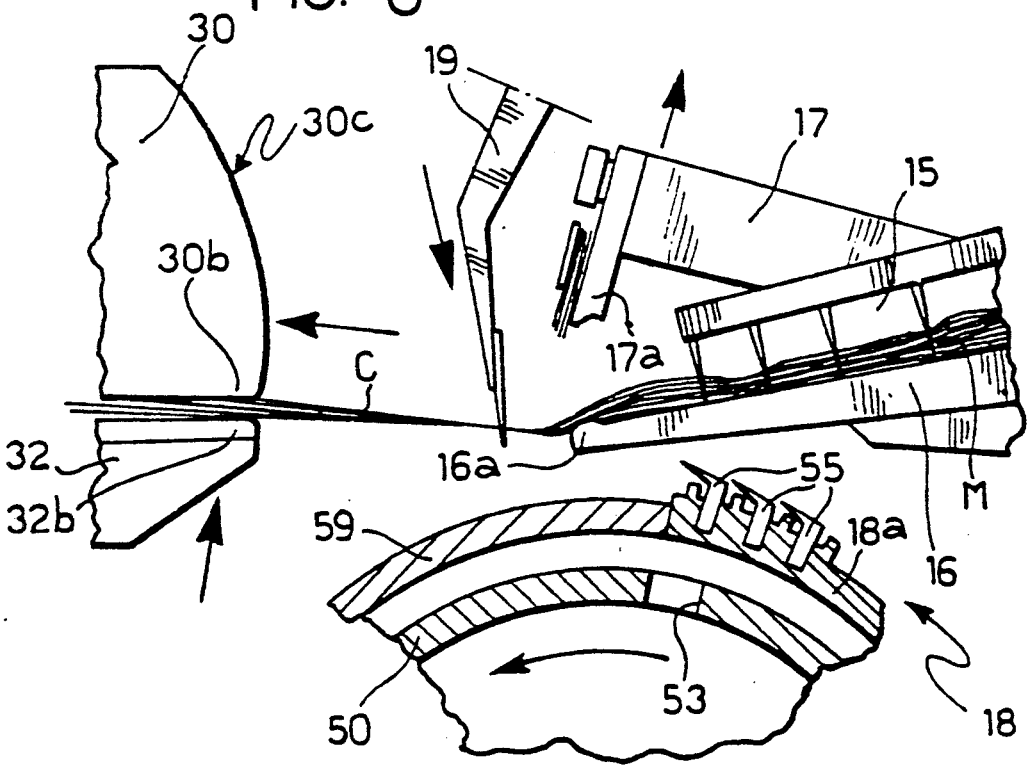
FIG. 6 is a detail of FIG. 4 on an enlarged scale.
Figure 7:
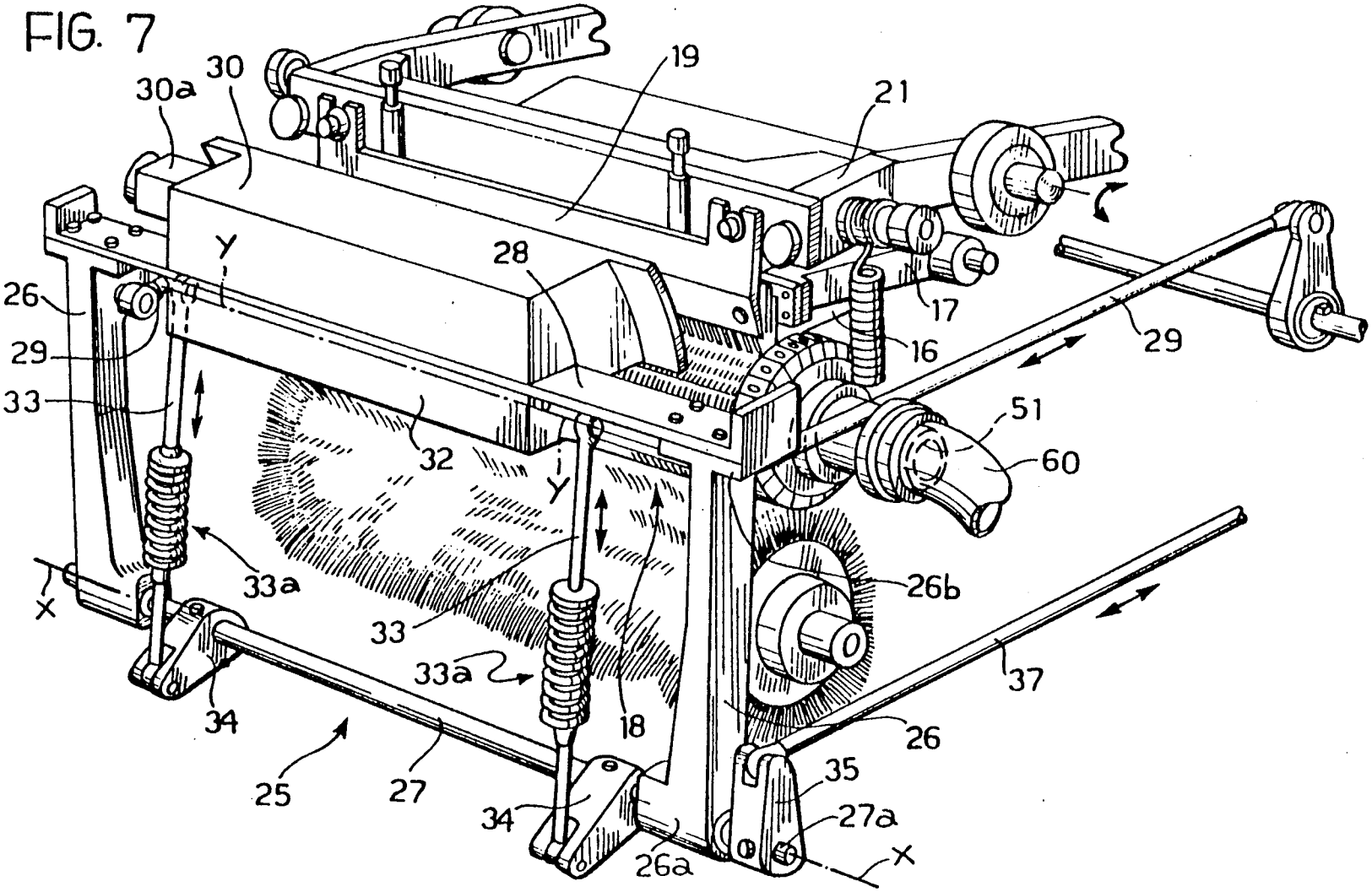
FIG. 7 is a perspective view of part of the machine of FIG. 1 on an enlarged scale.
Figure 8:
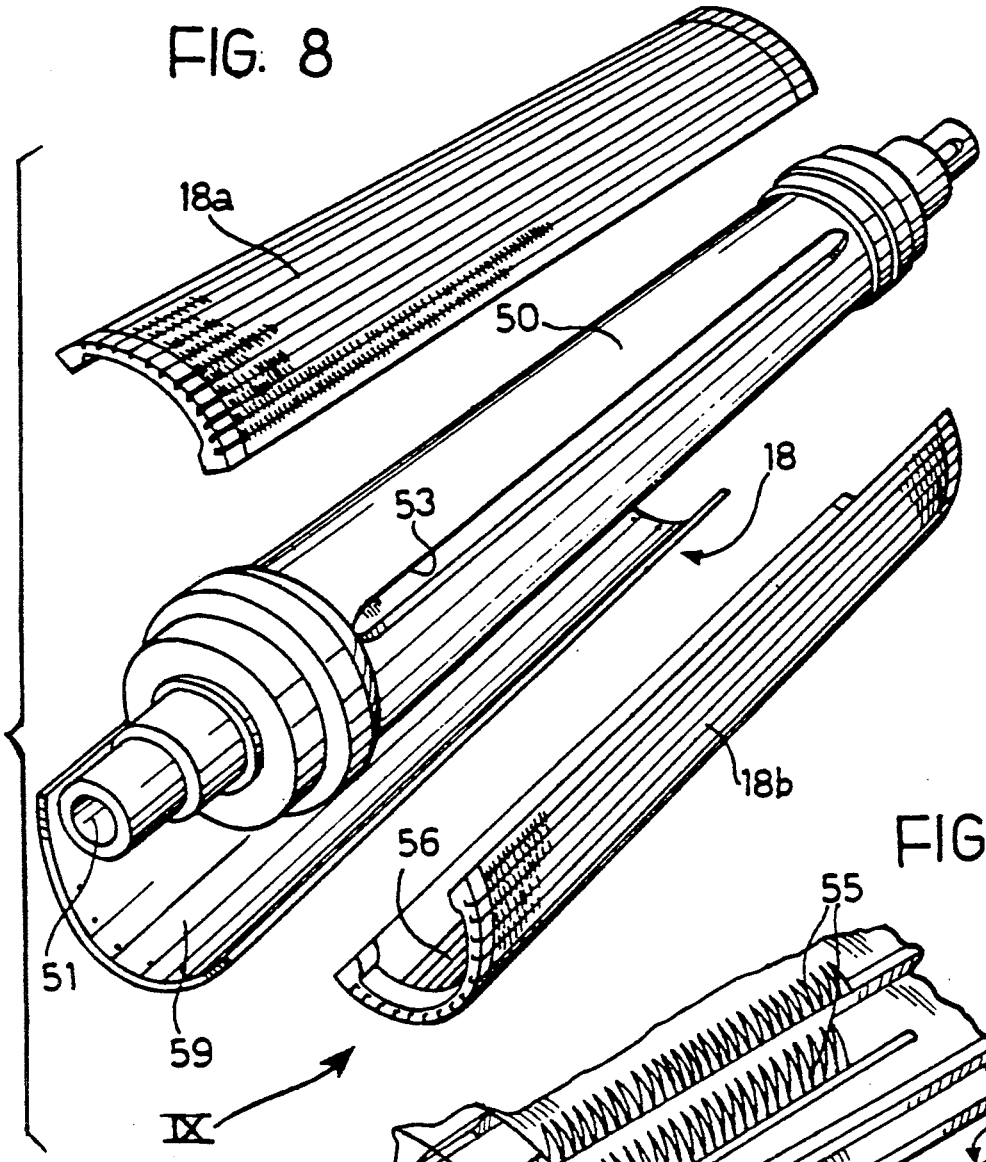
FIG. 8 is an exploded perspective view of a component of the machine.
Figure 9:
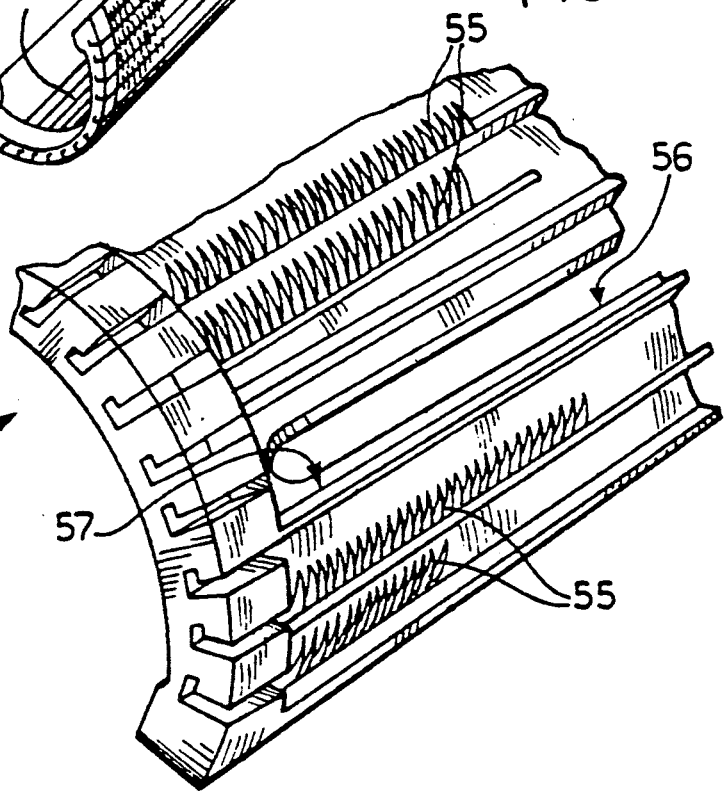
FIG. 9 is a view of a detail of FIG. 8 on an enlarged scale.

During the next stage, shown in FIG. 3, the upper nipper 17 moves away from the lower nipper 16 and simultaneously cleans the straight comb 19 by means of the brush 23. At the same time, the jaws 30*b* and 32*b*, which are in the open configuration, close on the tuft C so as to grip it between them and initiate the subsequent detachment stage shown in FIG. 4.

During this last stage, the straight comb 19 combs the rear end of the tuft C whilst, by virtue of the oscillation of the assembly 25, the tuft is separated from the web M which is retained by the array of needles 15. At the end of the detachment stage, the opening of the second jaw 32*b* away from the first jaw 30*b* formed by the manifold 30 causes the tuft to be drawing into the duct 40 and into the delivery tubing 43 towards the flock store.

To advantage, the suction in the manifold 30 is maintained throughout the operating cycles of the machine so as to facilitate the gripping of the tuft C which, as a result of the suction, aligns itself between the lower nipper 16 and the gripping line of the jaws 30*b* and 32*b* when the manifold 30 moves toward the nippers 16 and 17.

With the machine described above, the gauge can be reduced considerably in comparison with conventional combing machines, enabling it to be reduced to less than 15-16 mm. This is made possible both by the use of pincers for the detachment instead of conventional detaching rollers and by virtue of the particular shape of the jaws associated with the oscillating assembly 25. In parallel with the reduction in the gauge, particularly short wools can be combed effectively with low percentages of waste.

What is claimed is:

1. A rectilinear combing machine for combing a sliver of fibres, particularly of wool, comprising a support structure, a circular comb mounted for rotation on the structure, feeding means for feeding the sliver to the circular comb, and detachment means driven in synchronism with the rest of the machine for gripping combed fibre tufts and detaching them from the sliver, said detachment means comprising an oscillating assembly pivoted at its lower end to the structure of the machine about a substantially horizontal axis perpendicular to the feed direction of the sliver of fibres, a first straight jaw connected to the top of the oscillating assembly and substantially parallel to the axis of articulation of the oscillating assembly, a second straight jaw pivoted to the oscillating assembly and arranged parallel to the first straight jaw, drive means for causing the second jaw to oscillate in synchronism with the movement of the oscillating assembly to grip a combed fibre tuft between said first and second jaws, and suction means associated with said first and second jaws for transporting detached fibre tufts pneumatically toward fibre collection means.

2. A machine according to claim 1, wherein said drive means comprises at least one connecting rod having one end pivoted to a lever keyed to a shaft coaxial with the axis of articulation of the oscillating assembly and supported for rotation on the structure, at least one auxiliary lever being keyed to the shaft and pivoted to a first end of an auxiliary connecting rod, a second end of the auxiliary connecting rod being pivoted to the second jaw about an articulation axis parallel to the axis of articulation of the second jaw to the oscillating assembly, the auxiliary connecting rod having a portion which can be compressed resiliently axially so as to clamp with a predetermined force.

3. A machine according to claim 1, wherein one of the two jaws has an aperture facing the other jaw and communicating with a vacuum source.

4. A rectilinear combing machine for combing a sliver of fibres, particularly of wool, comprising a support structure, a circular comb mounted for rotation on the structure, feeding means for feeding the sliver to the circular comb, and detachment means comprising jays driven in synchronism with the rest of the machine for ripping combed fibre tufts and detaching them from the sliver, wherein said jaws have associated suction means for transporting detached fibre tufts pneumatically towards fibre collection means and wherein said circular comb is in the form of a hollow cylinder having a plurality of teeth thereon, at least one substantially longitudinal, elongate aperture in a lateral wall thereof and an interior portion in communication with a vacuum source so as to facilitate the penetration of the fibres of the tuft between the teeth of the comb by suction.

5. A machine according to claim 4, wherein the elongate aperture is located in a base of a longitudinal recess in the wall of the circular comb.

6. A machine as set forth in claim 4, wherein the circular comb has associated means for alternately enabling and preventing communication between the vacuum source and the elongate aperture in synchronism with the rotation of the circular comb.

7. A method for the straight combing of a sliver of fibres including the steps of feeding the sliver to a circular comb and combing the end of the sliver of fibres by the rotation of the circular comb, providing centripetal suction in correspondence with a wall of the circular comb at the start of the combing of the end of the fibres of the sliver so as to improve penetration of the fibres between teeth on the circular comb, gripping an end of the fibres of the sliver in a gripping device and moving the end away from the remaining portion of the sliver so as to separate the end therefrom, and releasing the grip on the fibres and drawing them by suction toward storage means.

* * * * *